US006068421A

United States Patent [19]

Pierpont

[11] Patent Number: 6,068,421

[45] Date of Patent: May 30, 2000

[54] PROTECTIVE SHELL FOR A COSMETIC CONTAINER

[75] Inventor: Robert L. Pierpont, Meriden, Conn.

[73] Assignee: Rexam Cosmetic Packaging, Inc., Torrington, Conn.

[21] Appl. No.: 09/139,421

[22] Filed: Aug. 25, 1998

[51] Int. Cl.[7] ..... A45D 40/04

[52] U.S. Cl. ..... 401/78; 220/796; 401/98

[58] Field of Search ..... 401/78, 98, 202; 220/799, 796

[56] References Cited

U.S. PATENT DOCUMENTS

| | | | |
|---|---|---|---|
| 2,349,800 | 5/1944 | Lee | 401/98 |
| 3,252,446 | 5/1966 | Bateman | 401/202 |
| 3,374,048 | 3/1968 | Koskinen . | |
| 3,991,775 | 11/1976 | Spatz | 401/78 |
| 3,991,777 | 11/1976 | Powers et al. . | |
| 4,511,050 | 4/1985 | Nicol . | |
| 5,119,838 | 6/1992 | Nakazima | 401/202 X |
| 5,297,883 | 3/1994 | Ozu . | |
| 5,324,125 | 6/1994 | Ackerman | 401/78 |
| 5,451,114 | 9/1995 | Ishigaki | 401/202 |
| 5,551,789 | 9/1996 | Okawa et al. . | |
| 5,609,430 | 3/1997 | Mazzola et al. | 401/78 X |
| 5,680,946 | 10/1997 | Cochran | 220/796 X |
| 5,863,144 | 1/1999 | Ackermann | 401/78 |

FOREIGN PATENT DOCUMENTS

| | | | |
|---|---|---|---|
| 2406973 | 6/1979 | France | 401/98 |

*Primary Examiner*—David J. Walczak
*Assistant Examiner*—Kathleen J. Prunner
*Attorney, Agent, or Firm*—Alston & Bird LLP

[57] ABSTRACT

A protective shell for a cosmetic container including a tubular topshell and a tubular baseshell for maintaining the moisture level of a cosmetic housed therein. The tubular topshell and tubular baseshell each include a mating portion and a mating member. The mating portion of the topshell is defined by an outwardly tapered sidewall portion. The mating portion of the baseshell is defined by an inwardly tapered sidewall portion. The topshell is placed on the baseshell and a seal is formed between the mating portions. The topshell mating member according to one embodiment is defined by a circumferential rib and the baseshell mating member is defined by a circumferential channel which receives the topshell rib. According to a second embodiment, the topshell mating member is defined by a circumferential band of depending projections and the baseshell mating member is defined by a circumferential band of upending projections for mating with the topshell depending projections. The mating members further seal the protective shell, provide a tactile indicator that the topshell is mated with the baseshell, and prevents unintentional removal of the topshell.

23 Claims, 4 Drawing Sheets

PROTECTIVE SHELL FOR A COSMETIC CONTAINER

FIELD OF THE INVENTION

The present invention is directed to a sealed protective shell for a cosmetic container including a topshell and a baseshell for maintaining the moisture level of cosmetic housed therein.

BACKGROUND OF THE INVENTION

Cosmetics, such as lipsticks, often include moisture rich ingredients rendering the composition volatile. It is desirable, therefore, for cosmetic containers, such as lipstick containers, to adequately protect the lipstick by providing a sealed enclosure to retain the moisture level of the lipstick and to prevent external moisture from contacting the lipstick. This thereby improves lipstick performance and extends the shelf life of the product.

To be fully protective, the topshell should be secured to the baseshell to prevent unintentional removal of the topshell. If the topshell is easily removed, it may be unintentionally removed resulting in damage to the lipstick. Additionally, the lipstick may contact and stain other objects and volatile moisture may escape. Moisture may particularly escape if the topshell is not sealed to the baseshell for extended periods of time such as when the topshell is unknowingly removed from the baseshell. This may cause the lipstick to dry out, diminishing both its performance and consumer satisfaction. It is therefore often desirable to provide positive indication, such as tactile indication, that the topshell is sealingly secured to the baseshell so that the user can confidently seal the protective shell.

SUMMARY OF THE INVENTION

It is therefore an object of the present invention to provide a protective shell for a cosmetic which maintains the cosmetic's moisture level.

It is also an object of the present invention to provide a protective shell including a topshell which is secured to the baseshell to avoid unintentional removal of the topshell.

It is also an object of the present invention to provide positive indication that the topshell is sealingly mated with the baseshell.

These and other objects are achieved by the cosmetic container of the present invention having a protective, sealed outer shell. The protective shell includes a tubular topshell and a tubular baseshell which enclose a cosmetic receiving receptacle. The cosmetic receiving receptacle is generally defined by an inner sleeve having a pair of longitudinal slots, an outer sleeve having a pair of helical channels along its inner surface, and/or a cosmetic carrier which defines a cup for receiving the cosmetic. The cosmetic carrier includes a pair of radially outwardly extending lugs which extend through the longitudinal slot of the inner sleeve and are received within a respective helical channel of the outer sleeve. Accordingly, relative rotational movement between the inner and outer sleeves, such as by rotation of the inner sleeve, causes the cosmetic carrier to traverse the length of the helical channel to extend and retract the cosmetic for application and storage, respectively. The inner sleeve may be attached, such as by an appropriate adhesive, to the baseshell wherein rotation of the baseshell provides relative rotational movement between the inner and outer sleeves to extend and retract the cosmetic carrier.

The protective shell is sealed and the topshell is securely mated with the baseshell due, at least in part, to the configuration of mating portions and mating members of the topshell and baseshell. The topshell is defined by a tubular sidewall, an upper wall, and an open lower end. The baseshell is defined by a bottom wall, a tubular sidewall, and an open upper end. The topshell and baseshell each include a mating portion which preferably is defined by a tapered portion. The topshell mating portion is defined by a tapered portion which tapers radially outwardly in the direction of the open lower end. The baseshell mating portion is defined by a reduced diameter portion which contacts the topshell when mated therewith. The reduced diameter portion tapers radially inwardly in the direction of the open upper end of the baseshell and defines the baseshell mating portion. The mating portions thereby secure the topshell to the baseshell and provide a seal so that moisture does not volatilize and escape from within the protective shell. Additionally, external moisture does not enter into the protective shell to affect the moisture level of the cosmetic.

The topshell and baseshell each also include a mating member for further securing the topshell to the baseshell to prevent unintentional removal of the topshell and/or the escape or entrance of moisture. The mating member of the topshell according to a first embodiment of the present invention includes a radially inwardly and circumferentially extending rib in the form of an annular bead positioned adjacent the open lower end of the topshell. The mating member of the baseshell includes a circumferential channel positioned adjacent the intersection of the reduced diameter portion and a larger diameter portion of the baseshell. According to this embodiment, the topshell bead mates with the channel of the baseshell to further seal the container and to provide a tactile indication that the container is sealed.

According to a second embodiment, the baseshell mating member includes upstanding, angular projections extending adjacent one another to form a circumferential band of such projections. The topshell mating member includes a band of depending angular projections adjacent the open lower end of the topshell which mate with the mating member of the baseshell. This arrangement, when mated, provides an additional seal for the protective shell and a tactile indication that the members are sealed. The ramp configuration of the mating members also promotes easy topshell removal in that slight rotation of the topshell causes the topshell to rise, thereby breaking the seal of the protective shell.

BRIEF DESCRIPTION OF THE DRAWINGS

The foregoing and other objects, features, and advantages of the present invention will be made apparent from the following detailed description of the preferred embodiment of the invention and from the drawings, in which.

DETAILED DESCRIPTION OF THE DRAWINGS

Figure 1:
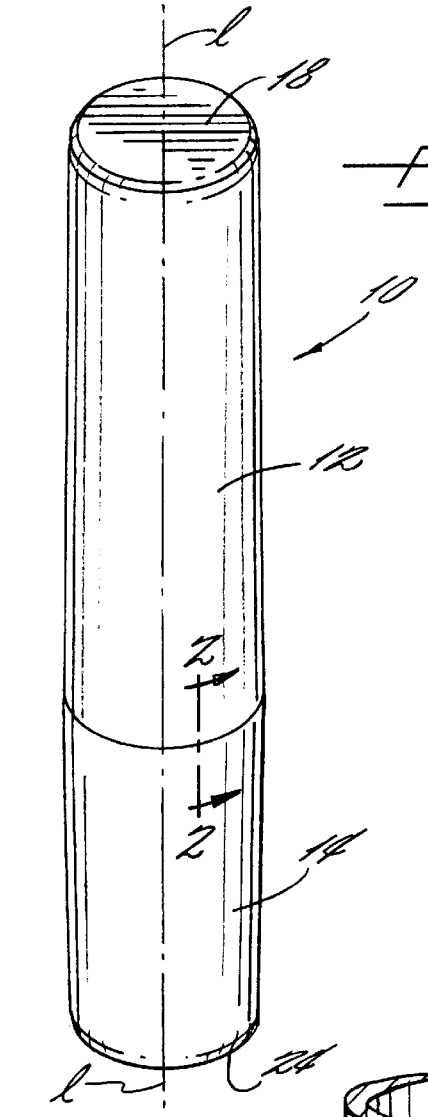
FIG. 1 is a perspective view of a cosmetic container according to a first embodiment of the present invention.

The present invention will now be described more fully in detail with reference to the accompanying drawings, in which preferred embodiments of the invention are shown. This invention should not, however, be construed as limited to the embodiments set forth herein; rather, they are provided so that this disclosure will be thorough and complete and will fully convey the scope of the invention to those skilled in the art.

The present invention is shown and described herein as a container for applying cosmetics, such as lipstick. For the sake of brevity, the description which follows will refer to a lipstick container. However, it should be evident that the container has utility in various other areas wherein a product is to be extended from and retracted into a case. For instance, the container may be utilized for any product requiring topical application.

The lipstick container protective shell according to the present invention is shown generally at 10. The protective shell 10 includes a tubular topshell 12 and a tubular baseshell 14. The tubular topshell 12 includes an annular topshell sidewall 16, a topshell upper wall 18, and an open lower end 20. The baseshell 14 includes an annular baseshell sidewall 22, a baseshell lower wall 24, and a baseshell open upper end 26. The baseshell 14 also includes a reduced diameter portion 28 positioned adjacent the open upper end 26 and a larger diameter portion 29 beneath the reduced diameter portion 28.

According to each of the embodiments, the baseshell is formed of a resilient material which has a low vapor transmission rate such as polyethylene or polypropylene. The topshell is formed of a material also having a low vapor transmission rate, but not necessarily the same material as the baseshell.

Figure 2:
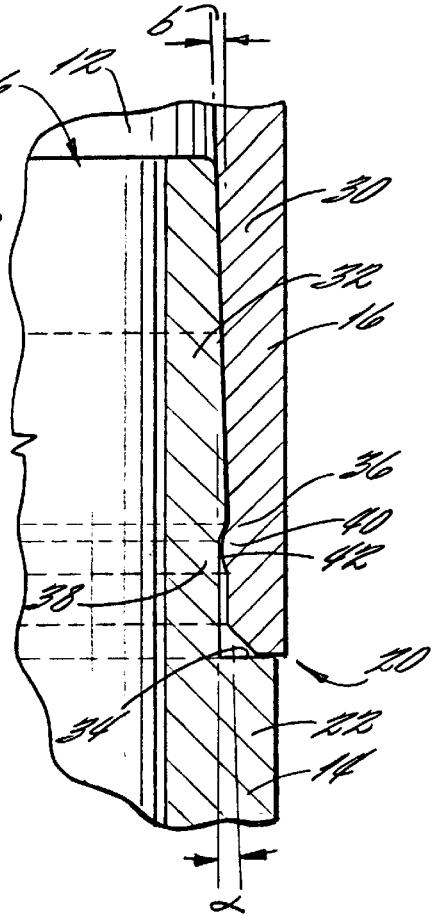
FIG. 2 is an enlarged cross-sectional view taken along lines 2—2 of FIG. 1.
Figure 5:
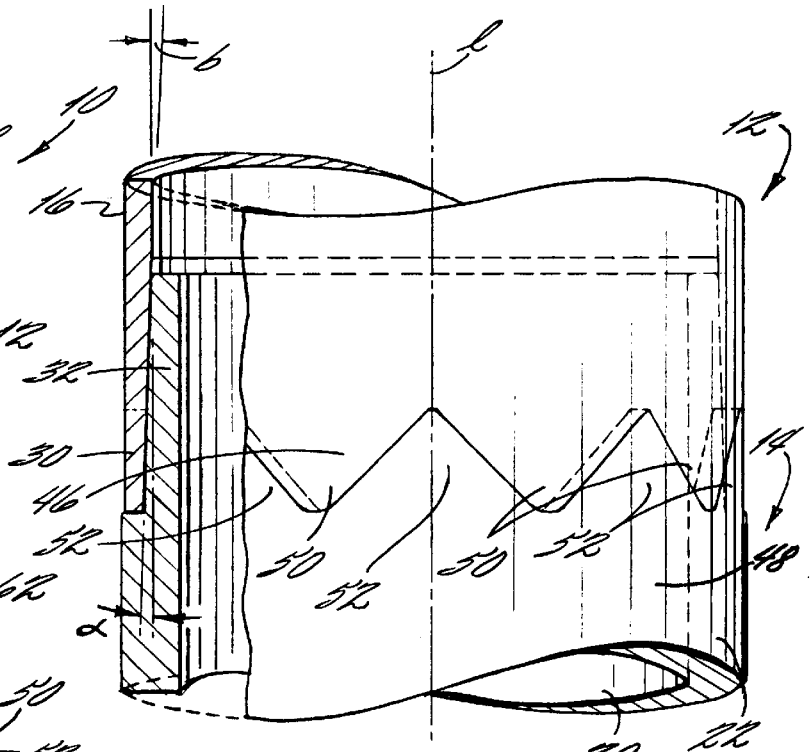
FIG. 5 is an enlarged, partial, cross-sectional view of the topshell and baseshell thereof.

The tubular topshell 12 includes a topshell mating portion 30 adjacent its open lower end 20. As illustrated in FIGS. 2 and 5, the topshell mating portion 30 is defined by a tapered portion which tapers radially outwardly in the direction of the open lower end 20. Preferably, the taper is defined by a reduced thickness of the tubular topshell sidewall 16 wherein the thickness of the sidewall 16 decreases in the direction of the open lower end 20. As illustrated, the inner surface of the topshell sidewall 16 thereby tapers radially outwardly in the direction of the open end 20. The angle b represents the angular orientation of the topshell sidewall 16. The angle b is preferably between about 1° and 3°, such as between about 1° and 2°. It is within the scope of the present invention, however, for both the inner and outer surfaces of the sidewall 16 to extend at an angle with respect to the vertical axis to define the tapered topshell mating portion 30.

Figure 3:
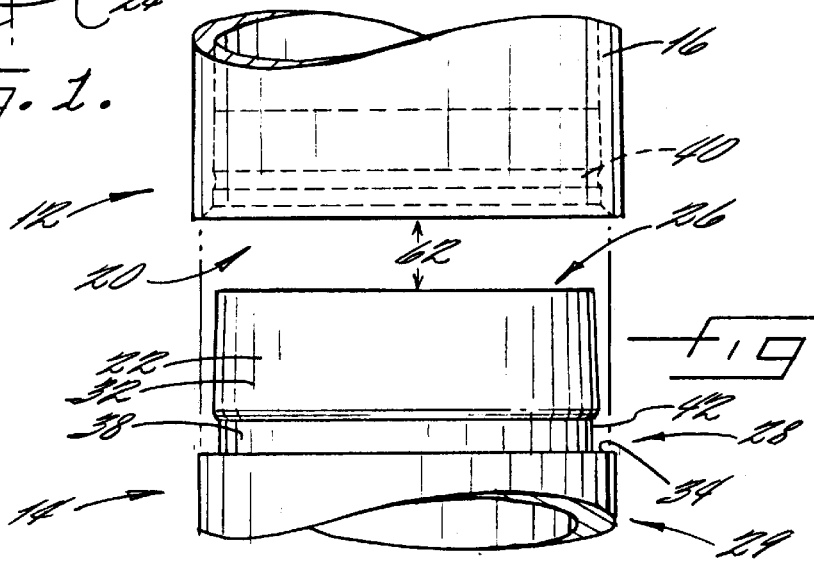
FIG. 3 is an enlarged, exploded view of the topshell and the baseshell thereof.
Figure 6:
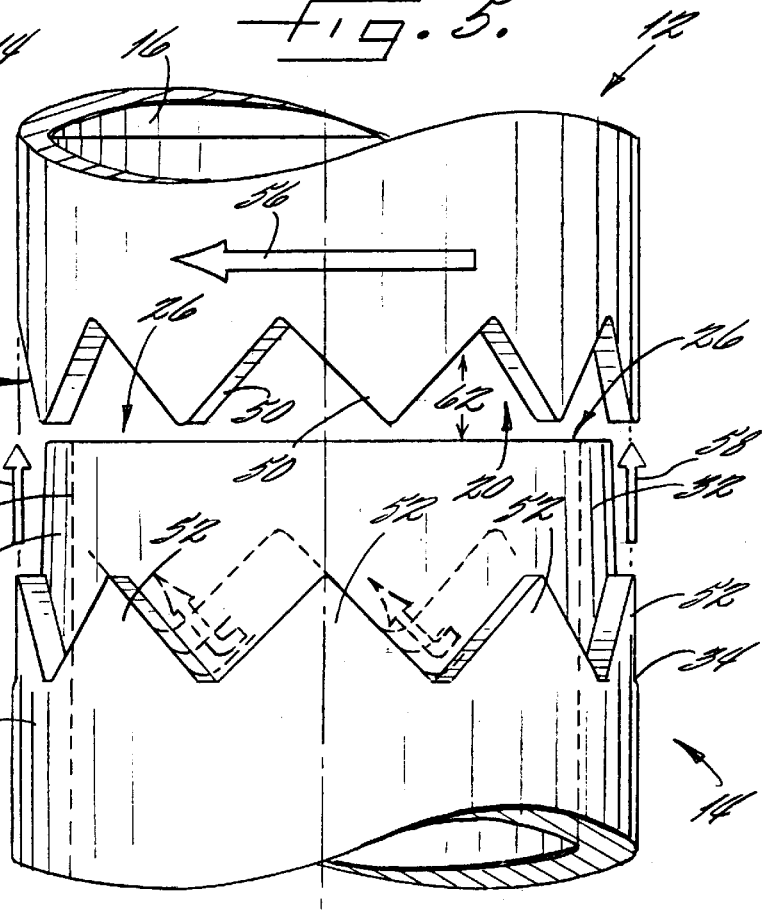
FIG. 6 is an enlarged, exploded view of a portion of the topshell and the baseshell thereof.

A baseshell mating portion 32 is provided to mate with the topshell mating portion 30. As best illustrated in FIGS. 3 and 6, the reduced diameter portion 28 of the baseshell 14 includes the mating portion 32 which is likewise defined by a tapered portion. The tapered portion forming the baseshell mating portion 32 is positioned adjacent the open upper end 26 of the baseshell 14, in the area of the reduced diameter portion 28. The tapered portion is defined by the sidewall 22 of the baseshell 14 having a thickness which decreases in the direction of the open upper end 26. Accordingly, the outer surface of the baseshell mating portion 32 tapers radially inwardly. The angle $\alpha$ represents the angular orientation of the sidewall 22 relative to the longitudinal axis l. The angle $\alpha$ is preferably between about 1° and 3°, such as between about 1° and 2°. As illustrated, the inner surface of the sidewall 22 defining the baseshell mating portion is substantially vertical and the outer surface of the sidewall 22 diverges inwardly to define the taper. Of course, it is within the scope of the present invention for both the inner and outer surfaces of the sidewall 22 to extend at an angle with respect to the longitudinal axis l.

As best represented in FIG. 2, the baseshell 14 thereby receives the topshell 12 wherein the topshell mating portion 30 and the baseshell mating portion 32 engage one another to frictionally secure the members of the protective shell 10. The topshell mating portion 30 and the baseshell mating portion 32 form a seal due, at least in part, to the close tolerances of the various members. Preferably, the topshell 12 and baseshell 14 are formed of a material having a predetermined degree of inherent flexibility. The protective shell 10 is thereby sealed to maintain an appropriate moisture level of the cosmetic housed therein.

The protective shell 10 according to the first embodiment of the present invention, illustrated in FIGS. 1–3, further includes a topshell mating member 36 and a baseshell mating member 38. The topshell mating member 36 is in the form, as illustrated, of a circumferential rib 40 which extends radially inwardly from the inner surface of the topshell sidewall 16. Preferably, the rib 40 is an annular bead which has a semi-circular cross-section as illustrated in FIG. 2. The baseshell mating member 38 includes a circumferentially extending channel 42 configured to receive the circumferential rib 40 of the adjacent topshell 12. Preferably, the channel 42 is positioned adjacent the lower end of the reduced diameter portion 28 of the baseshell 14, adjacent the baseshell larger diameter portion 29.

The reduced diameter portion 28 has an outer diameter which is less than the larger diameter portion 29 of the tubular baseshell 14. This thereby defines a shoulder 34 against which the tubular topshell 12 abuts. The shoulder 34 prevents downward axial movement of the tubular topshell 12 when it is positioned upon the baseshell 14.

Accordingly, the rib 40 is received within the circumferential channel 42 when the topshell 12 is mated with the baseshell 14. The combination of the topshell mating member 36 and the baseshell mating member 38 provides a tactile indication to the user that the topshell 12 is secure on the baseshell 14. A noticeable click may result when the rib 40 mates with the channel 42. The combination also further secures and/or seals the topshell 12 to the baseshell 14. The topshell 12 may be removed by pulling the topshell in the direction of the longitudinal axis l to break the seal and disengage the rib 40 from the channel 42.

Figure 4:
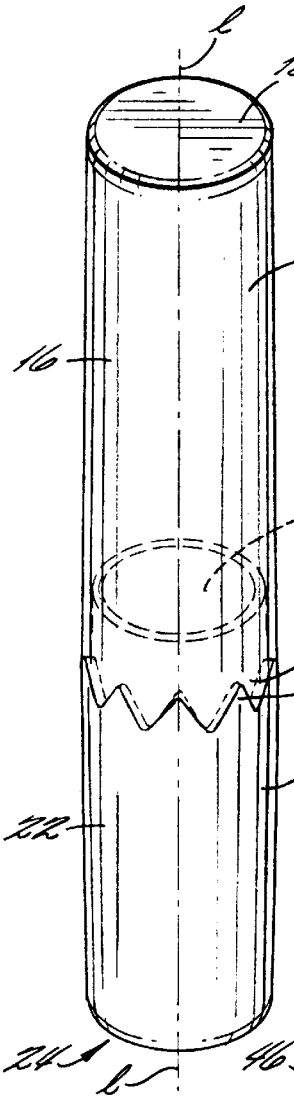
FIG. 4 is a perspective view of a cosmetic container according to a second embodiment of the present invention.

A second embodiment of the present invention is represented in FIGS. 4–6. This embodiment differs from the first embodiment with regard to the configuration of the mating members of the topshell 12 and the baseshell 14. According to this embodiment, a topshell mating member 46 is defined by a plurality of depending projections 50 defining the open lower end 20 of the tubular topshell 12. The plurality of depending projections 50 extend axially along the longitudinal axis l of the topshell 12. According to the illustrated embodiment, the depending projections 50 are V-shaped. They may, however, be differently configured such as they may be arcuate so as to define a sinusoidal lower edge (not shown). The topshell mating member 46 is positioned within the topshell mating portion 30 having tapered sidewalls 16. Accordingly, the projections 50 forming the mating member 36 are tapered, that is, decrease in thickness towards the open lower end 20 as discussed above.

A baseshell mating member 48 is defined by a plurality of upending projections 52 which are configured to mate with the depending projections 50 of the topshell 12. Similarly, the upending projections 52 extend along the longitudinal axis l of the topshell 12. According to the illustrated embodiment, the upending projections of the baseshell mating member 48 are defined by inverted V-shaped projections which extend circumferentially around the reduced diameter portion 28. The baseshell mating member 48 may be differently configured, such as arcuate (not shown), to mate with the topshell mating member 46. The baseshell mating member 48 defines a band which extends around the reduced diameter portion 28 forming the baseshell mating portion 32. The topshell 12 thereby abuts the baseshell mating member 38 which forms a shoulder for limiting downward axial movement of the topshell 12. The angular projections of both the topshell 12 and baseshell 14 substantially define about a 90° angle between adjacent projections.

Accordingly, the topshell mating member 46 and the baseshell mating member 48 further secure the topshell 12 to the baseshell 14. This feature also provides a tactile indicator that the protective shell 10 is sealingly closed. Furthermore, rotational movement in one direction, such as represented by arrow 56 in FIG. 6, releases the seal of the protective shell 10. The configuration of the mating members 46,48 thereby enable easy removal upon rotation of the topshell 12. The ramp configuration of the mating members 46, 48 encourages removal of the topshell 12 when the seal has been broken between the topshell 12 and the baseshell 14. Of course, the topshell 12 may also be removed along the longitudinal axis of the container such as is represented by arrow 58 in FIG. 6.

Figure 7:
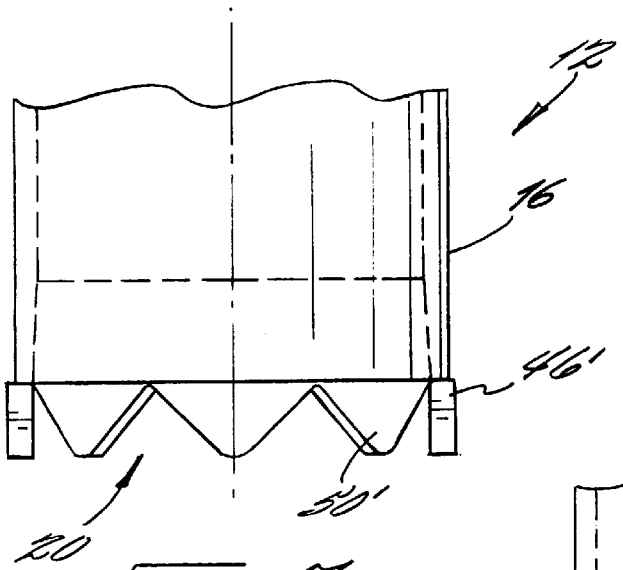
FIG. 7 is an enlarged view of a topshell according to a third embodiment of the present invention.

FIG. 7 represents a third embodiment of the present invention. This embodiment includes a topshell mating member 46' which is defined by a plurality of depending projections 50' which form a circumferential band similar to that of the second embodiment. This embodiment differs, however, in that the circumferential band of the mating member 46' has a wall thickness which is greater than the thickness of the topshell sidewall 16. Accordingly, the outer surface of the topshell mating member 46' extends radially outwardly beyond the topshell sidewall 16. The corresponding baseshell 14 is similar to that of the second embodiment. The outwardly extending surface defined by the topshell mating member 46' therefore provides a decorative element to the protective shell 10.

Figure 8:
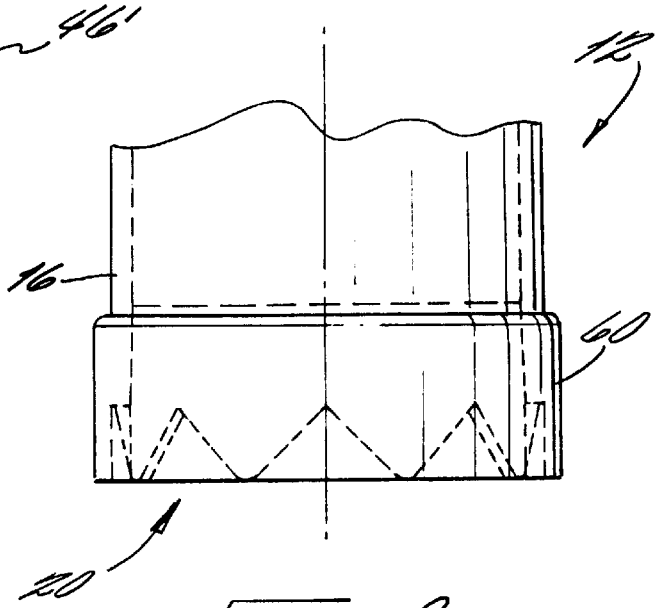
FIG. 8 is an enlarged view of a topshell according to a fourth embodiment of the present invention.

A fourth embodiment of the present invention is represented in FIG. 8. This embodiment is similar to the second embodiment, however, a circumferential sheath 60 is provided which extends circumferentially around the topshell mating member 46 (shown in phantom in FIG. 8). The circumferential sheath 60 thereby encloses the seam formed between the mated topshell mating member 46 and baseshell mating member 48. The circumferential sheath 60 therefore extends radially outwardly from the topshell sidewall 16 and abuts the baseshell shoulder 34.

Figure 9:
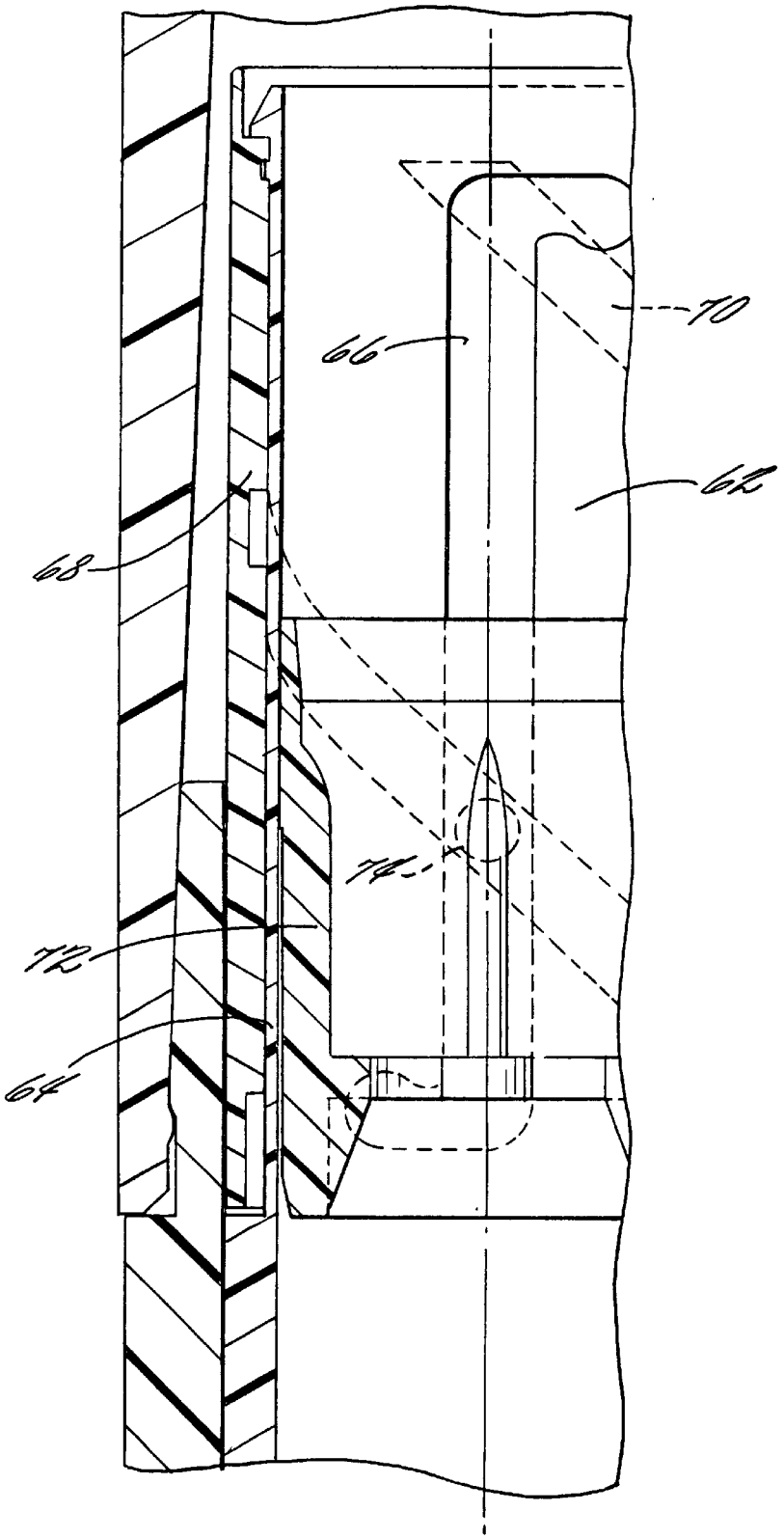
FIG. 9 is a partial, cross-sectional view of the cosmetic receiving receptacle of the present invention.

The cosmetic receiving receptacle, shown generally at 62 in the various figures, such as FIG. 9, is generally defined by an inner sleeve 64 having a pair of longitudinal slots 66, an outer sleeve 68 having a pair of helical channels 70 along its inner surface, and/or a cosmetic carrier 72 which defines a cup for receiving the cosmetic. The cosmetic carrier 72 includes a pair of radially outwardly extending lugs 74 which extend through the longitudinal slot 66 of the inner sleeve 64 and are received within a respective helical channel 70 of the outer sleeve 68. Accordingly, relative rotational movement between the inner 64 and outer 68 sleeves, such as by rotation of the inner sleeve 64, causes the cosmetic carrier 72 to traverse the length of the helical channel 70 to extend and retract the cosmetic for application and storage, respectively. The inner sleeve 64 may be attached, such as by an appropriate adhesive, to the tubular baseshell 14 wherein rotation of the baseshell 14 provides relative rotational movement between the inner and outer sleeves to extend and retract the cosmetic.

While particular embodiments of the invention have been described, it will be understood, of course, the invention is not limited thereto since modifications may be made by those skilled in the art, particularly in light of the foregoing teachings. It is therefore, contemplated by the appended claims to cover any such modifications that incorporate those features of these improvements in the true spirit and scope of the invention.

What is claimed is:

1. A cosmetic container having a protective shell comprising:

a tubular topshell having an annular topshell sidewall defining an open lower end, said tubular topshell sidewall including a topshell mating portion adjacent said open lower end, said topshell mating portion being tapered radially outwardly and including a topshell mating member;

a tubular baseshell having an annular baseshell sidewall defining an open upper end, said baseshell sidewall including a baseshell mating portion which is tapered radially inwardly to mate with said tapered topshell mating portion and to substantially seal and frictionally engage said tubular topshell, said baseshell mating portion including a baseshell mating member which cooperates with said topshell mating member to removably secure said tubular topshell and said tubular baseshell; and a cosmetic receiving receptacle positioned within said tubular baseshell.

2. A cosmetic container according claim 1 wherein said topshell mating portion is defined by a decreased thickness of said topshell sidewall wherein an inner surface of said topshell sidewall is tapered radially outwardly.

3. A cosmetic container according to claim 1 wherein said baseshell mating portion is defined by a decreased thickness of said baseshell sidewall wherein an outer surface of said baseshell sidewall is tapered radially inwardly.

4. A cosmetic container according to claim 1 wherein said topshell mating member is a rib extending radially inwardly and said baseshell mating portion further defines a channel for receiving said topshell mating member.

5. A cosmetic container according to claim 4 wherein said baseshell mating portion has a maximum outer diameter which is less than an outer diameter of remaining portions of said tubular baseshell.

6. A cosmetic container according to claim 4 wherein said rib extends circumferentially about said topshell mating portion.

7. A cosmetic container according to claim 6 wherein said rib is an annular bead.

8. A cosmetic container according to claim 4 wherein said channel extends circumferentially about said baseshell mating portion.

9. A cosmetic container according to claim 1 wherein said topshell sidewall and said baseshell sidewall are tapered about 1 to 3 degrees.

10. A cosmetic container according to claim 9 wherein said topshell sidewall and said baseshell sidewall are tapered about 1 to 2 degrees.

11. A cosmetic container according to claim 1 wherein said tubular baseshell defines a shoulder for limiting downward axial movement of said tubular topshell.

12. A cosmetic container according to claim 1 wherein said topshell mating member includes a plurality of depending projections adjacent said open lower end, said plurality of depending projections extending axially along a longitudinal axis of said topshell and said baseshell mating member includes a plurality of upending projections extending axially along a longitudinal axis of said tubular baseshell adjacent a lower end of said baseshell mating portion wherein said plurality of depending projections cooperate with said plurality of upending projections to seal said protective shell.

13. A cosmetic container according to claim 12 wherein said plurality of upending projections of said tubular baseshell define a shoulder for limiting downward axial movement of said tubular topshell.

14. A cosmetic container according to claim 12 wherein said plurality of depending projections extend circumferentially around said open lower end of said tubular topshell and said plurality of upending projections extend circumferentially around said open upper end of said tubular baseshell.

15. A cosmetic container according to claim 12 wherein said plurality of upending projections and said plurality of depending projections are angular so as to define a band of angular projections about said tubular topshell and said tubular baseshell.

16. A cosmetic container according to claim 15 wherein each of said angular projections is substantially V-shaped.

17. A cosmetic container according to claim 16 wherein said plurality of angular projections define about a 90 degree angle between adjacent angular projections.

18. A cosmetic container according to claim 12 further comprising a sheath extending circumferentially around said tubular topshell, radially outwardly of said plurality of depending projections.

19. A cosmetic container according to claim 12 wherein said plurality of depending projections of said tubular topshell have an outer diameter which is greater than an outer diameter of said tubular topshell.

20. A cosmetic container according to claim 1 further comprising a tubular outer sleeve defining a helical channel at least along an inner surface thereof.

21. A cosmetic container according to claim 20 wherein said cosmetic receiving receptacle is a cosmetic carrier having at least one radially outwardly extending lug for cooperating with said helical channel to extend and retract the cosmetic carrier along a longitudinal axis of said cosmetic container.

22. A protective shell for a cosmetic container comprising:

a tubular topshell having an annular topshell sidewall defining an open lower end, said tubular topshell sidewall including a topshell mating portion adjacent said open lower end, said topshell mating portion being tapered radially outwardly and including a topshell mating member defined by a circumferential rib extending radially inwardly from said tubular topshell sidewall adjacent said open lower end; and a tubular baseshell having an annular baseshell sidewall defining an open upper end, said baseshell sidewall including a baseshell mating portion which is tapered radially inwardly to mate with said tapered topshell mating portion and to substantially seal and frictionally engage said tubular topshell, said baseshell mating portion including a baseshell mating member defined by a circumferential channel for receiving said topshell mating member and for cooperating therewith to removably secure said tubular topshell and said tubular baseshell to further seal said protective shell.

23. A protective shell for a cosmetic container comprising:

a tubular topshell having an annular topshell sidewall defining an open lower end, said tubular topshell sidewall including a topshell mating portion adjacent said open lower end, said topshell mating portion being tapered radially outwardly and including a topshell mating member defined by a plurality of depending projections adjacent said open lower end, said plurality of depending projections extending axially along a longitudinal axis of said topshell; and a tubular baseshell having an annular baseshell sidewall defining an open upper end, said baseshell sidewall including a baseshell mating portion which is tapered radially inwardly to mate with said tapered topshell mating portion and to substantially seal and frictionally engage said tubular topshell, said baseshell mating portion including a baseshell mating member defined by a plurality of upending projections extending axially along the longitudinal axis of said tubular baseshell adjacent a lower end of said baseshell mating portion wherein said plurality of depending projections cooperate with said plurality of upending projections to seal said protective shell.

* * * * *